US005984149A

United States Patent [19]

Thanisch et al.

[11] Patent Number: 5,984,149

[45] Date of Patent: Nov. 16, 1999

[54] ALL PLASTIC TRIGGER PUMP

[75] Inventors: Klaus Thanisch, Bullay; Klaus Natersky, Peterswald-Loffelscheid, both of Germany

[73] Assignee: Spraysol GmbH, Sobernheim, Germany

[21] Appl. No.: 08/557,648

[22] Filed: Nov. 13, 1995

[30] Foreign Application Priority Data

Nov. 11, 1994 [GB] United Kingdom ..... 9422826

[51] Int. Cl.[6] ..... B67D 5/40

[52] U.S. Cl. ..... 222/340; 222/382; 222/383.1

[58] Field of Search ..... 222/321.7, 321.8, 222/340, 380, 382, 383.1; 239/333

[56] References Cited

U.S. PATENT DOCUMENTS

| | | | |
|---|---|---|---|
| 3,768,734 | 10/1973 | Anderson, Jr. et al. | 239/333 |
| 4,155,487 | 5/1979 | Blake | 222/383 X |
| 4,191,313 | 3/1980 | Blake et al. | 222/335 |
| 4,227,650 | 10/1980 | McKinney | 222/380 X |
| 4,489,861 | 12/1984 | Saito et al. | 222/257 |
| 4,618,077 | 10/1986 | Corsette | 222/383.1 |
| 4,872,596 | 10/1989 | Corsette | 222/383 X |
| 4,958,754 | 9/1990 | Dennis | 222/383.1 |
| 5,228,602 | 7/1993 | Maas et al. | 222/340 |
| 5,335,858 | 8/1994 | Dunning et al. | 239/333 |
| 5,423,460 | 6/1995 | Thomann | 222/383.1 X |

FOREIGN PATENT DOCUMENTS

| | | | |
|---|---|---|---|
| 2 274 620 A2 | 7/1988 | European Pat. Off. . | |
| 0 505 299 A1 | 9/1992 | European Pat. Off. . | |
| 0 529 254 A1 | 3/1993 | European Pat. Off. . | |
| 0 598 237 A2 | 5/1994 | European Pat. Off. . | |
| 0 599 459 A1 | 6/1994 | European Pat. Off. . | |
| 2 382 274 | 10/1977 | France . | |
| 2 418 032 | 2/1979 | France . | |
| 2 461 530 | 7/1979 | France . | |
| 87 13 891 | 10/1987 | Germany . | |
| 39 31 602 A1 | 9/1989 | Germany . | |
| 800757 | 9/1958 | United Kingdom . | |
| 0 064 672 | 11/1983 | United Kingdom . | |
| 9413408 | 6/1994 | WIPO | 239/333 |

OTHER PUBLICATIONS

Search Report of British Application No. 9422826.9.

*Primary Examiner*—Joseph A. Kaufman
*Attorney, Agent, or Firm*—Woodcock Washburn Kurtz Mackiewicz & Norris LLP

[57] ABSTRACT

A trigger pump dispenser is made entirely from thermoplastic resin materials. It has a trigger (17) pivotally attached to the body (13) at its top end. The trigger is attached by a living hinge to a piston 16 movable within a pump cylinder (40), and is biased by a spring (18) to the retracted position shown. The spring is generally L-shaped and anchored to the body by its bottom leg so as to straddle the pump cylinder. A unitary valve member (15) located at the back of the pump cylinder provides one-way valves both for product dispensing and for product recharging into the pump chamber.

29 Claims, 10 Drawing Sheets

20
196
194
13

194
202
204
198
206

196
210
212
200

ALL PLASTIC TRIGGER PUMP

SUMMARY OF THE INVENTION

This invention relates to dispensers for liquid products, of the kind which have a trigger operable to drive a piston along a pump chamber against the action of a spring, and so to force liquid product under pressure from the pump chamber and through a dispensing orifice in a nozzle. Such dispensers are frequently referred to as "trigger pump dispensers", an appellation which is hereinafter used for brevity. It will be understood that the dispenser has one-way valves associated with its inlet and outlet flow paths, for controlling product flow from and to the pump chamber.

A known desideratum of trigger pump dispensers is that they should be made wholly of thermoplastic resin materials for easy recyclability after use. This invention is concerned to provide such a trigger pump dispenser which is easy to assemble, reliable in use, and has a small number of parts. To this end the invention provides a trigger pump dispenser having several aspects which may be used individually or in combination.

Accordingly, a first aspect of the invention provides a trigger pump dispenser, characterized in that the spring for the trigger is generally L-shaped in cross-section, having upper and lower arms joined at an elbow from which they each extend generally forwardly of the pump dispenser body below the pump chamber, and the upper arm being flexible and resilient, cantilevered from the lower arm at the elbow, and movably engaged at its free end with the trigger.

A second aspect of the invention provides a trigger pump dispenser which has a unitary valve member having inner and outer portions arranged one within the other with apertures formed through the valve member between them, the inner portion providing the one-way valve for the inlet flow path and the outer portion providing the one-way valve for the outlet flow path, characterized in that the apertures form a part of each of the inlet and outlet flow paths.

These aspects and novel features of the invention are incorporated in preferred trigger pump dispensers in accordance with the invention which will now be described, by way of example, with reference to the accompanying drawings.

DETAILED DESCRIPTION

Figure 1:
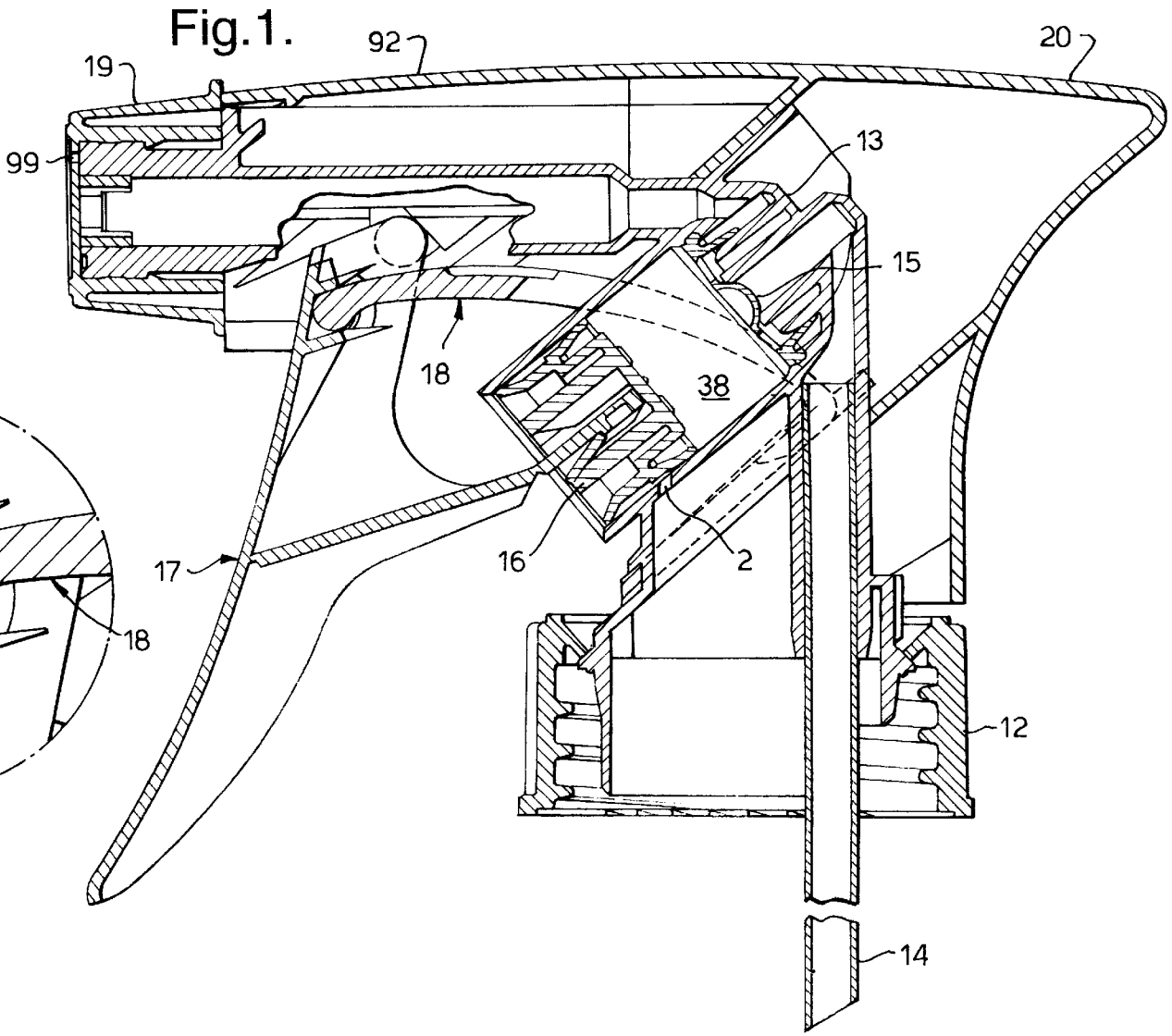
FIG. 1 shows a first preferred trigger pump dispenser as seen in central section.

In the drawings of the three preferred pump dispensers, like reference numerals are generally used to indicate like or equivalent parts.

A trigger pump dispenser for liquid products is shown generally in central cross-section in FIG. 1. It is assembled from nine parts each one of which is molded from a suitable thermoplastic resin material. The dispenser as a whole is therefore made entirely from plastic, with the accompanying advantages for recycling. The parts of the dispenser and the reference numbers which are given to them are as follows:

| | |
|---|---|
| Screw-on Closure | 12 |
| Body | 13 |
| Diptube | 14 |
| Valve member | 15 |
| Piston | 16 |
| Trigger | 17 |
| Spring | 18 |
| Nozzle | 19 |
| Shroud | 20 |

The arrangement of the parts 12 to 20, and the manner in which they are attached to one another will become apparent from the following description.

The screw-on closure 12 is molded from polypropylene. It has an internal screw thread 22 (FIG. 2) by which it and the dispenser as a whole may be attached to the neck of a plastic bottle containing a liquid product, for example, a liquid cleaner for windows. The bottle may be conventional, and is therefore not shown or described.

At its top end the closure 12 has a large opening 23 surrounded by a frustoconical flexible flange 24 which extends to its free edge 25 downwardly and inwardly towards the interior of the closure.

The body 13 is molded from polypropylene. It has a hollow tube-like mouth which is externally formed with a peripheral enlargement 28. A frustoconical upper surface 30 of the enlargement is engaged by the free edge 25 of the flange 24 to hold the body captive in the closure when the closure is fitted to a bottle. For the initial assembly of the closure on the body the flange 24 has sufficient flexibility to allow it to snap over the enlargement 28 so that it can adopt the position shown in FIG. 1.

The body 13 extends below the enlargement 28 as a hollow spigot 31 which is capable of making a sealing engagement with the bore of the bottle neck. Above the enlargement the body is reduced in diameter at a constricted region or neck 32 generally of rectangular cross-section. At the back of the dispenser, that is to say, on the right hand side of FIG. 1, the body is formed with a vertical tube 34 into the bottom end of which the top end of the diptube 14 is push-fitted. In use of the dispenser the bottom end of the diptube is located in the liquid product at the bottom of the bottle in known manner. The diptube is a polypropylene extrusion.

Figure 6A:
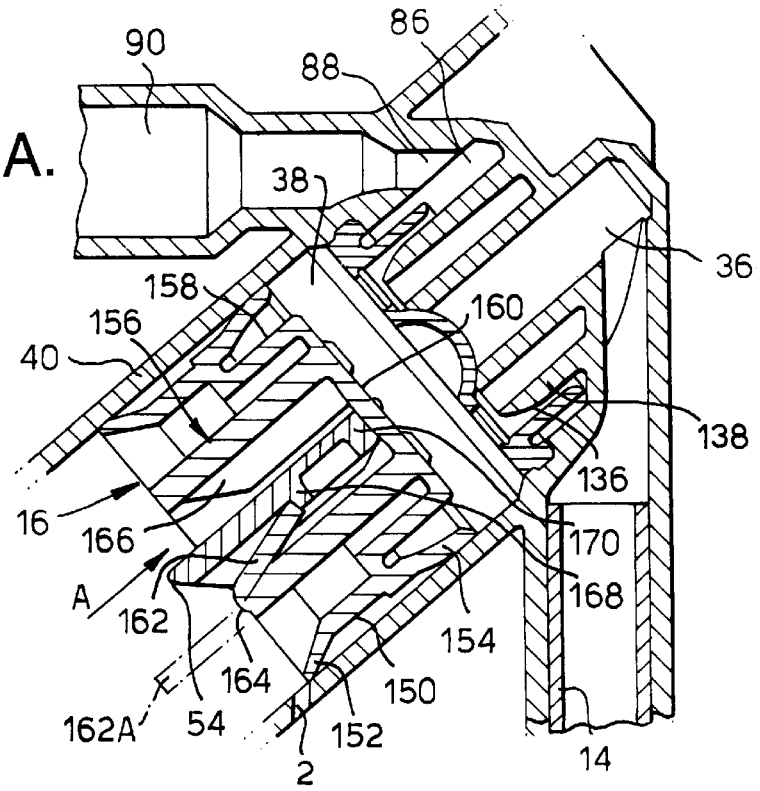
FIGS. 6A and 6B are scrap views respectively showing operation of the valve member during the product dispensing and pump chamber recharging phases of operation of the first dispenser.
Figure 6B:
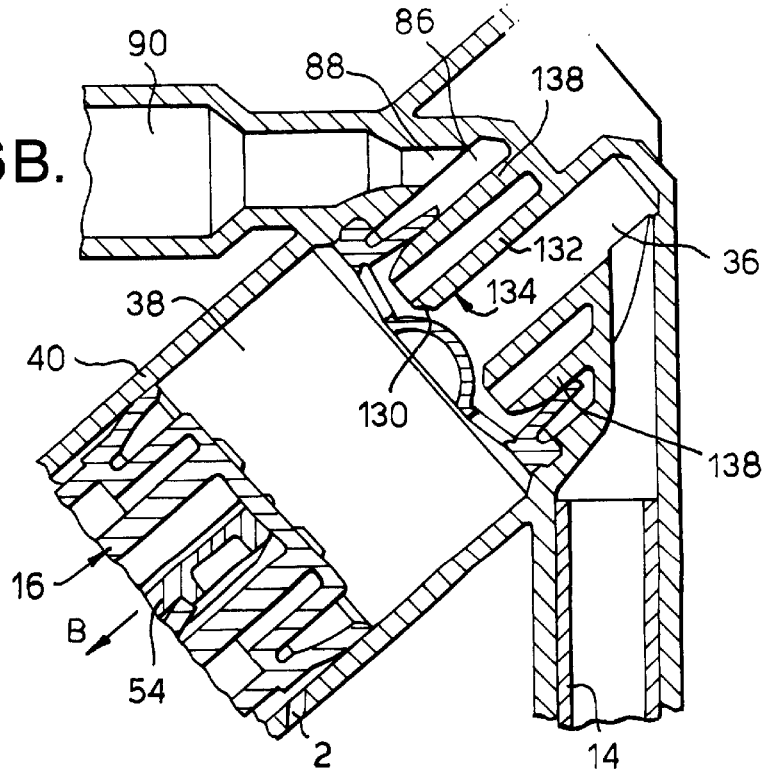

As is clearly shown in FIGS. 6A and 6B, above the top end of the diptube 14 the tube 34 communicates with the entry passage 36 for a cylindrical pumping chamber 38. This chamber is formed within a pump cylinder 40 of the body which is inclined downwardly and forwardly of the dispenser at an angle of 45°. The valve member 15 is located at the top end of the pumping chamber, and, as will later become apparent, is capable of acting as a one-way valve allowing product flow from the entry passage to the pumping chamber (but not in the reverse direction); it also acts as a one-way valve for dispensing.

The forward (lower) end of the pumping chamber 38 is open, and the piston 16 is push-fitted and capable of reciprocating within it while making a fluid-tight seal with the bore of the pump cylinder 40.

The trigger 17 (FIG. 2), by which the piston may be reciprocated, is molded from polypropylene. It has a front plate 42 which is suitably contoured for the fingers of a user of the dispenser 10, and side plates 44 extending backwardly (i.e. to the right in FIG. 1) from the front plate.

Three generally parallel webs are formed within the trigger 17; they extend backwardly from the front plate 42 and are integrally attached to the side plates 44 along their side edges. Two of these webs, denoted 46 and 48, provide the trigger with a backwardly open socket in which the front end of the spring 18 can be snap-engaged. The third web, denoted 50, is integrally connected via a film or "living" hinge 52 to an extension 54 which is snap-engaged into the piston 16 so as to lie along the central axis of the latter.

The trigger 17 is pivotally mounted at its top end by circular bosses 56 of which one projects outwardly from each side plate 44. The bosses are snap-engaged into respective recesses 58 formed by resilient side plates 60 of the body. Spaced projecting lands 62, 64 on the side plates guide the bosses into the recesses 58 when the trigger is being fitted into position.

The arrangement of the piston 16 and its engagement with the pump cylinder 40 and with the trigger extension 54 are best seen in FIG. 6A. The piston is molded from high density polyethylene, and is generally cylindrical. It has an exterior tubular skirt 150 with resilient lips 152, 154 at its ends for sealing engagement with the pump cylinder. The skirt is carried in a resilient manner from a hollow central core 156 by a generally S-shaped intermediate section 158. The top end of the core is closed by a plane and circular crown 160 from the periphery of which the intermediate section extends. A tongue 162 is attached by a living hinge 164 to the open, lower end of the core, and extends in a reentrant manner into the core interior.

The tongue 162 is molded integrally with the piston 16 in the extended position indicated at 162A in FIG. 6A by broken lines, and is folded to its reentrant position opposite a longitudinal spline 166 before the trigger extension 54 is inserted into the piston core 156. As the trigger extension is being inserted into the piston core between the reentrant tongue and the spline, the tongue rides over and then engages behind a rib 168 which is formed across the underside of the trigger extension, thereby attaching the piston firmly to the trigger 16. In order to minimize looseness of the attachment made in this way, the trigger extension is extended right to the back face of the piston crown 160 where its free end is formed as an enlargement 170 which fits closely between the spline 166 and the opposed wall of the piston core. The trigger extension therefore extends for substantially the whole axial depth of the piston along its central axis.

Figure 2:
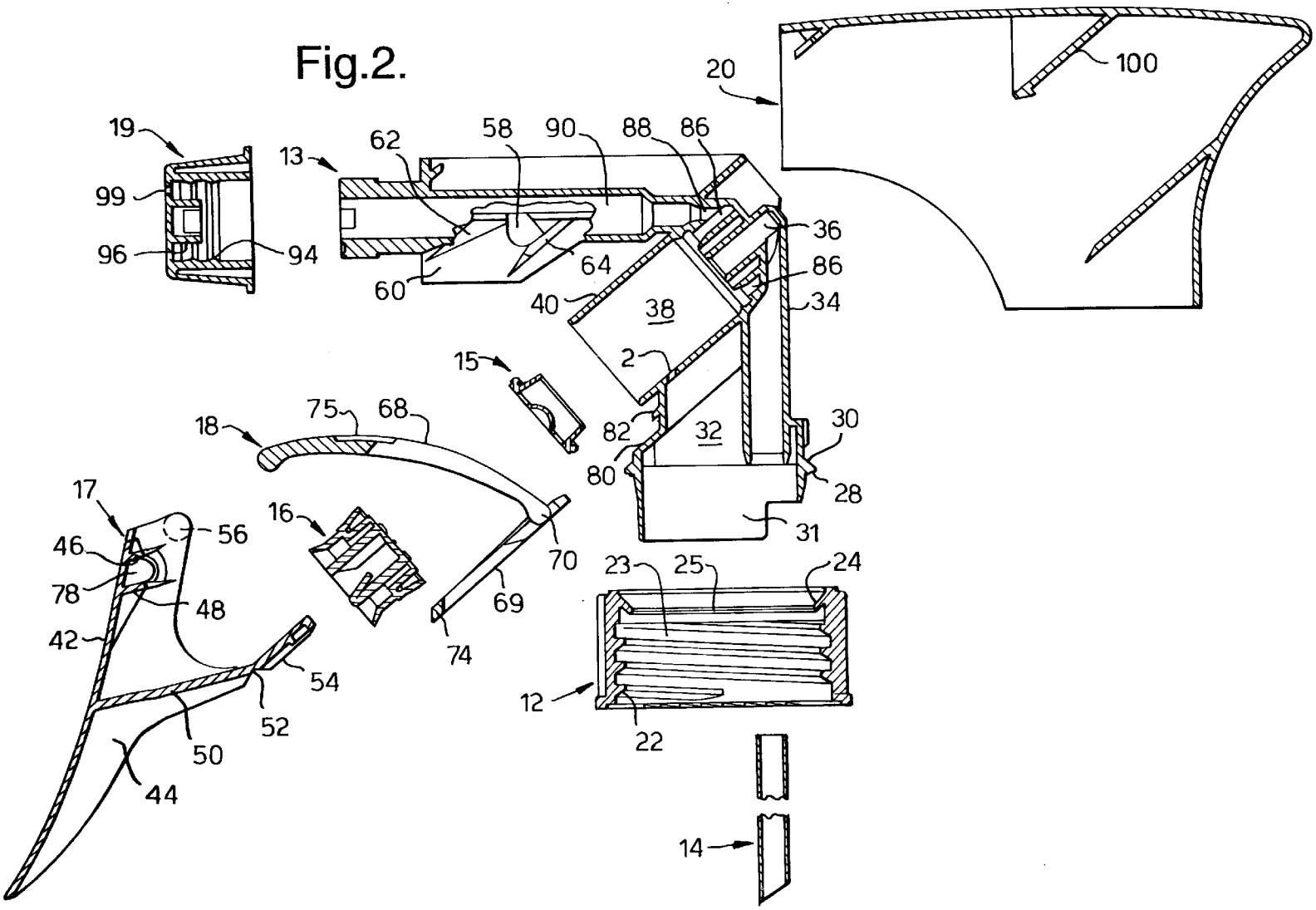
FIG. 2 is an exploded view of the first dispenser.
Figure 3:
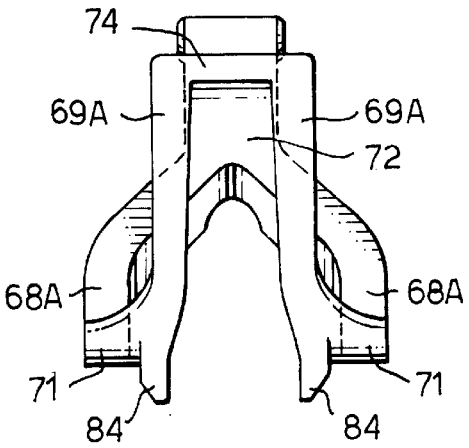
FIGS. 3 and 3A are enlarged views of the spring of the first dispenser, in plan view as seen respectively looking from below and from above the spring.

The spring 18 is variously shown in FIGS. 1 to 3. It is a unitary member molded from polyacetal, and in side elevation is generally L-shaped, with its upper and lower elongate arms 68, 69 disposed at an angle of about 60° to one another at the elbow 70 between them. The upper arm is formed with a gentle curve so as to be downwardly concave, and it is to be understood as having a high degree of flexibility and resilience to bending in the vertical plane.

Figure 3A:
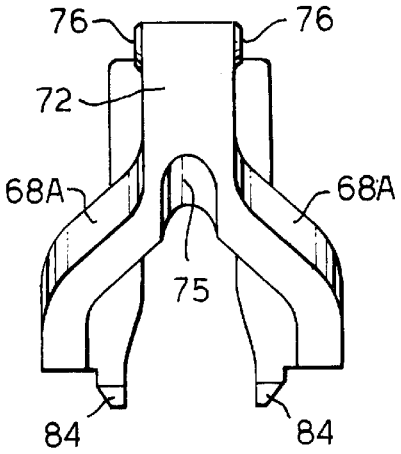

As shown in FIGS. 3 and 3A, each arm 68, 69 is bifurcated. It has two opposed parts which are mirror images of one another in relation to the centerline of the spring. The two parts 68A of the upper arm 68 converge towards their free ends where they are joined together by a yoke 72. The parts 69A of the lower arm 69 are rectilinear and parallel, and their free ends are joined together by a yoke 74.

Figure 7:
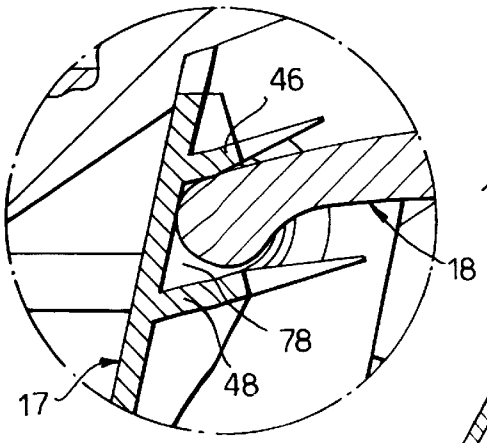
FIG. 7 is an enlarged view showing detail of the attachment of the spring of the first dispenser to its trigger.

Bosses 76 are formed in alignment on either side of the yoke 72 of the upper arm 68. In the assembled dispenser they are snap-engaged into recesses 78 FIGS. 2 and 7 which are formed on the side plates 44 of the trigger 17 between the webs 46, 48, so as to attach the trigger and the spring together for relative movement.

The lower arm 69 of the spring 18 is attached immovably to the body so as to support the upper arm 68 in cantilever manner. The lower arm rests on, and is supported by, a plane ledge 80 (FIG. 2) of the body, which has the same angle of inclination as, but is spaced from, the pump cylinder 40 above it. The lower arm is located in that position by engagement of its yoke 74 underneath a flange 82 which is formed along the front face of the body neck 32. A pair of tongues 84 projecting from the parts 69A of the lower arm at the elbow 70 engage within apertures (not shown) in the body 13 so as to restrain the back end of the lower arm similarly against movement.

The spring 18 is fitted to the body 13 before the trigger 17 or the closure 12 are fitted. To achieve this the lower arm is pushed up and along the ledge 80 so as to engage the tongues 84 and yoke 74 with their respective formations of the body. The lower arm 69 straddles the body neck 32, and the upper arm 68 straddles the pump cylinder 40, sufficient clearance being provided between the pump cylinder and the parts 68A of the upper arm to allow the required movement of the upper arm during operation of the dispenser. For that purpose, the separation of the parts 68A of the upper arm 68 is generally greater than that of the parts 69A of the lower arm 69, and the junctions of the parts 68A, 69A at the elbow 70 are arranged generally transversely of the spring.

As shown clearly in FIG. 2, at the back of the pumping chamber 38 the body 13 is arranged to provide an annular outlet passage 86 which is concentric with, and outside, the entry passage 36. This outlet passage communicates via a port 88 with a further passage 90 which is formed by the body along the dispenser barrel 92 (FIG. 1).

The passage 90 supplies product under pressure to the nozzle 19, which is snap-engaged by a bead 94 onto the free end of the body. The nozzle, which is molded from polypropylene, has a central core 96 which is an interference fit in the body, and an offset dispensing orifice 99. A swirl chamber (not shown) is associated with the dispensing orifice so as to give a desired spray pattern.

Figure 4:
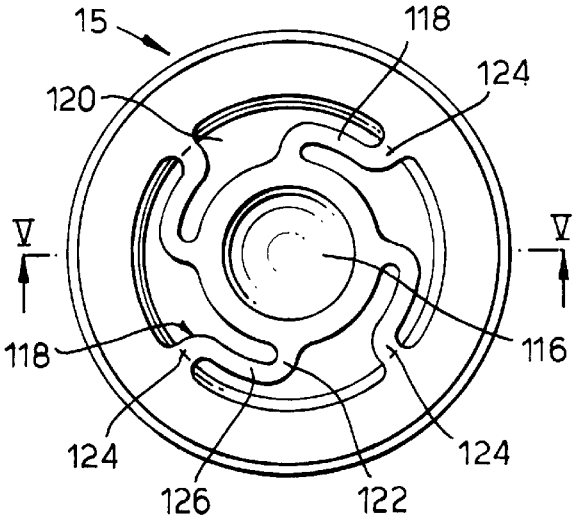
FIG. 4 is an enlarged plan view of the valve member of the first dispenser as seen from above.
Figure 5:
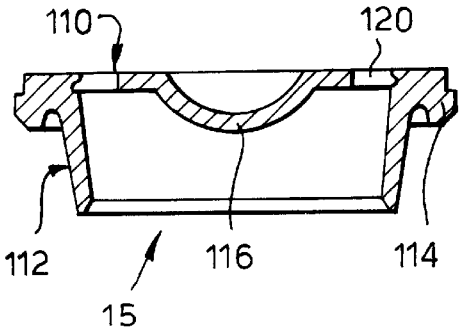
FIG. 5 shows the valve member in section taken along the line V—V of FIG. 4.

The arrangement of the valve member 15 and its cooperation with the body 13 are apparent from FIGS. 4 and 5 which show the valve member alone, and from FIGS. 6A and 6B which show the valve member in operation. Referring now to these drawings, the valve member is molded from a thermoplastic elastomer material which is marketed in Germany by Himont under the designation "ADFLEX". It is generally cup-shaped and circular, having a base 110 and a tubular skirt 112 which extends around the periphery of the base. The junction of the base with the skirt is surrounded by a collar portion 114.

The base 110 has an imperforate central dome 116 which projects from it in the same direction as the skirt 112. It is joined integrally to the inside diameter of the skirt by four thin and flexible arms 118 which are spaced around the valve member so as to form apertures 120 between them. The arms are generally S-shaped, having generally radially extending inner and outer end portions 122 and 124 and a generally circumferentially extending central portion 126. Because of their bent shape and substantial flexibility, the arms present little resistance to movement of the dome perpendicularly to the plane of the base.

As is apparent from FIGS. 6A and 6B, the collar portion 114 provides the means by which the valve member 15 may be held captive in the body 13. For that purpose it is received and held in an inwardly facing, complementary groove (not referenced), which is formed in the body. The dome 116 is then accommodated at the open front end of the entry passage 36, and likewise the skirt 112 is accommodated within the outlet passage 86. In the relaxed condition of the valve member, that is to say, when no pressure of product is exerted upon it, the dome engages a seat 130 (FIG. 6B) provided by the inner wall 132 of a double-walled tubular structure 134 by which the entry passage 36 and the outlet passage 86 are separated from one another. Correspondingly, the skirt engages a further seat 136 (FIG. 6A) which is provided by the external surface of the outer wall 138 of the tubular structure. As will later become apparent, each such engagement of the valve member with its seat 130 or 136 is capable of forming a seal against product flow past it at the appropriate time during operation of the dispenser.

The shroud 20 is molded from polypropylene. It is clipped over the body and retained in position by suitable internal formations such as the hollow boss designated 100. It closes the top, sides and back of the dispenser, and is contoured to provide a comfortable hand grip for the user in conjunction with the trigger 17.

The assembly of the dispenser in manufacture is carried out using the following assembly operations:

a) The valve member 15 is fitted into the body 13 by inserting it along the pump cylinder 40 and push-fitting it into its desired position;

b) The piston 16 is push-fitted into the pump cylinder 40 after the valve member 15;

c) The spring 18 is attached to the body 13 as described above;

d) With the valve member 15, piston 16 and spring 18 in position, the trigger 17 is snap-engaged with the body 13, the spring and the piston as described above; and, at a suitable time, e) The closure 12 is snap-fitted to the body 13;

f) The nozzle 19 is snap-fitted to the body 13; and g) The shroud is clipped onto the body 13.

After these assembly operations have been completed (in an appropriate sequence), the dispenser is ready for attachment to a bottle by means of the closure 12.

For use of the dispenser the trigger is pulled back against the action of spring 18, so causing the piston 16 to move in the direction of the arrow A (FIG. 6A) and to generate a superatmospheric pressure in the pump chamber 38. This pressure is transmitted through the apertures 120 and lifts the skirt 112 off its seat 136. Product which is already in the pump chamber 38 is therefore forced to flow via valve member 15, outlet passage 86, port 88, and further passage 90 to the orifice 99 for dispensing. During this movement the upper part 68 of the spring deforms resiliently in an upward direction and its concavity (in the downward direction) increases. A recess 75 (FIGS. 2 and 3A) is formed in the upper surface of the part 68 to prevent engagement with the barrel 92.

On subsequent release of the trigger 17 the spring resiliently forces the trigger back to the position shown, by relaxation of its upper arm 68 to its unstressed position. This movement of the trigger causes the piston 16 to be moved forward along the pump cylinder 40 in the direction of arrow B (FIG. 6B), so generating a partial vacuum in the pump chamber 38. The dome 116 of the valve member 15 is thereby moved towards the pump chamber on its arms 118, so breaking the seal which had previously existed between the dome and its seat 130. Product is accordingly drawn from the associated bottle to enter the pump chamber via diptube 14, entry passage 36 and valve member so as to recharge the pump chamber with product in preparation for a further dispensing operation.

It will be understood that the valve member 15 provides one-way valves for both the product dispensing and pump chamber recharging phases of operation of the dispenser. During a dispensing phase of operation, the dome 116 is forced by product pressure against its seat 130 so as to form a seal by which product is prevented from returning to the bottle. Likewise, when the pump chamber 38 is being recharged with product, the skirt 112 is drawn by partial vacuum against its seat 136, and the resulting seal prevents product (and possibly air) from entering the pump chamber from the barrel 92.

Venting for the headspace of the associated bottle is achieved by a hole 2 which is formed through the pump cylinder 40 as shown, so as to allow air to enter the bottle at the end of a dispensing stroke—see FIG. 6A. The hole is closed by the piston when the dispenser is not in use and during recharging—see FIGS. 1 and 6B.

From the foregoing description it will be understood that the dispenser is made wholly from thermoplastic resin materials, with the resultant advantages for recyclability; in particular, it has no metal, glass or thermosetting resin in any of its components. Moreover, the dispenser can be readily manufactured using purely mechanical assembly techniques, i.e. without any need for e.g. heat-sealing or bonding.

Figure 8:
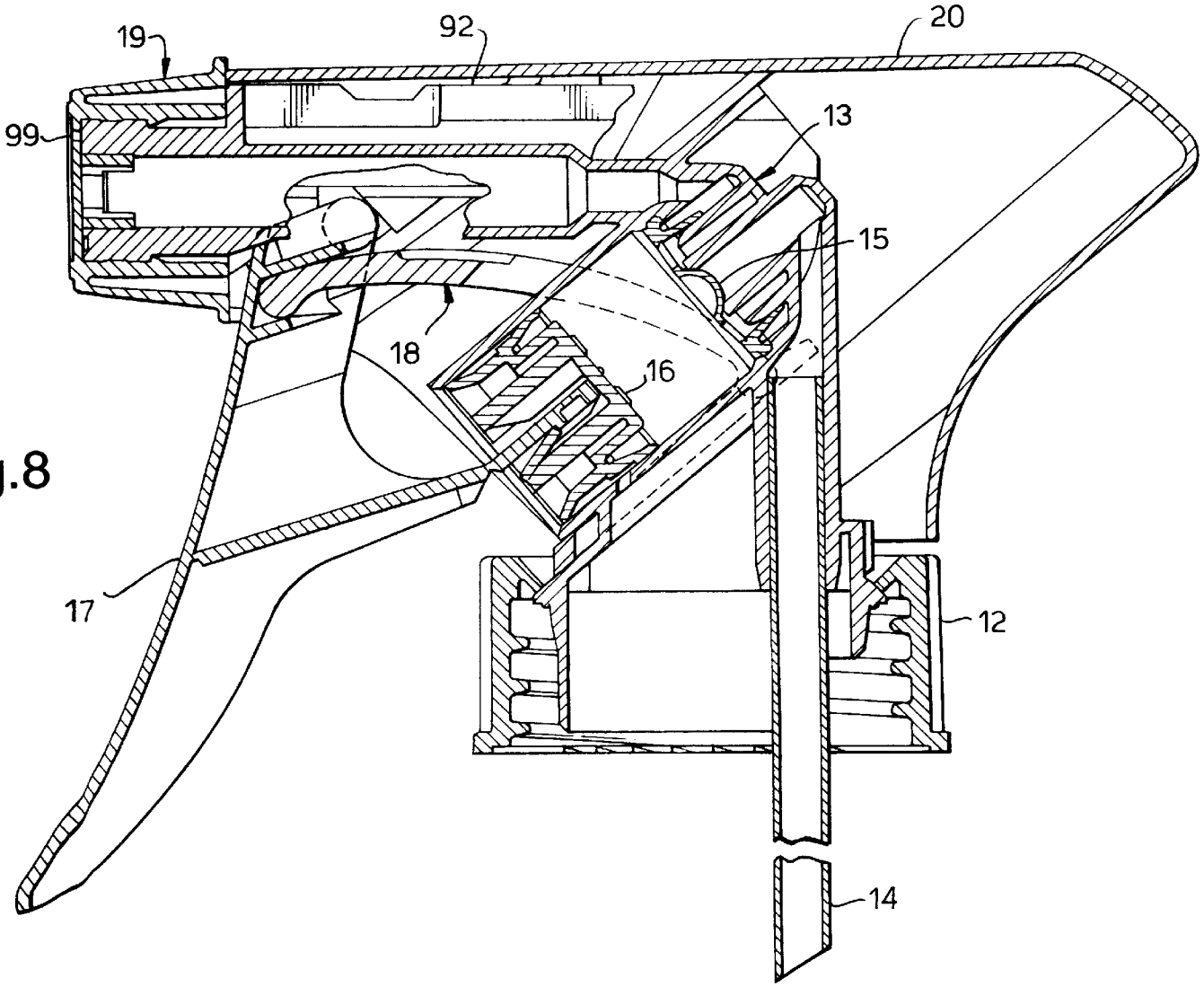
FIG. 8 is a view corresponding to FIG. 1 of a second preferred trigger pump dispenser in accordance with the invention.

A second preferred dispenser is shown in FIG. 8 in a view corresponding to FIG. 1. The difference between the second and first dispensers is largely dimensional, the general arrangement and mode of operation being unchanged. In particular, whereas in the first dispenser the lower arm 69 of the spring 18 is located beneath the flange 82 which is provided specially for that purpose, in the second dispenser it is directly located by the pump cylinder 40.

Figure 9:
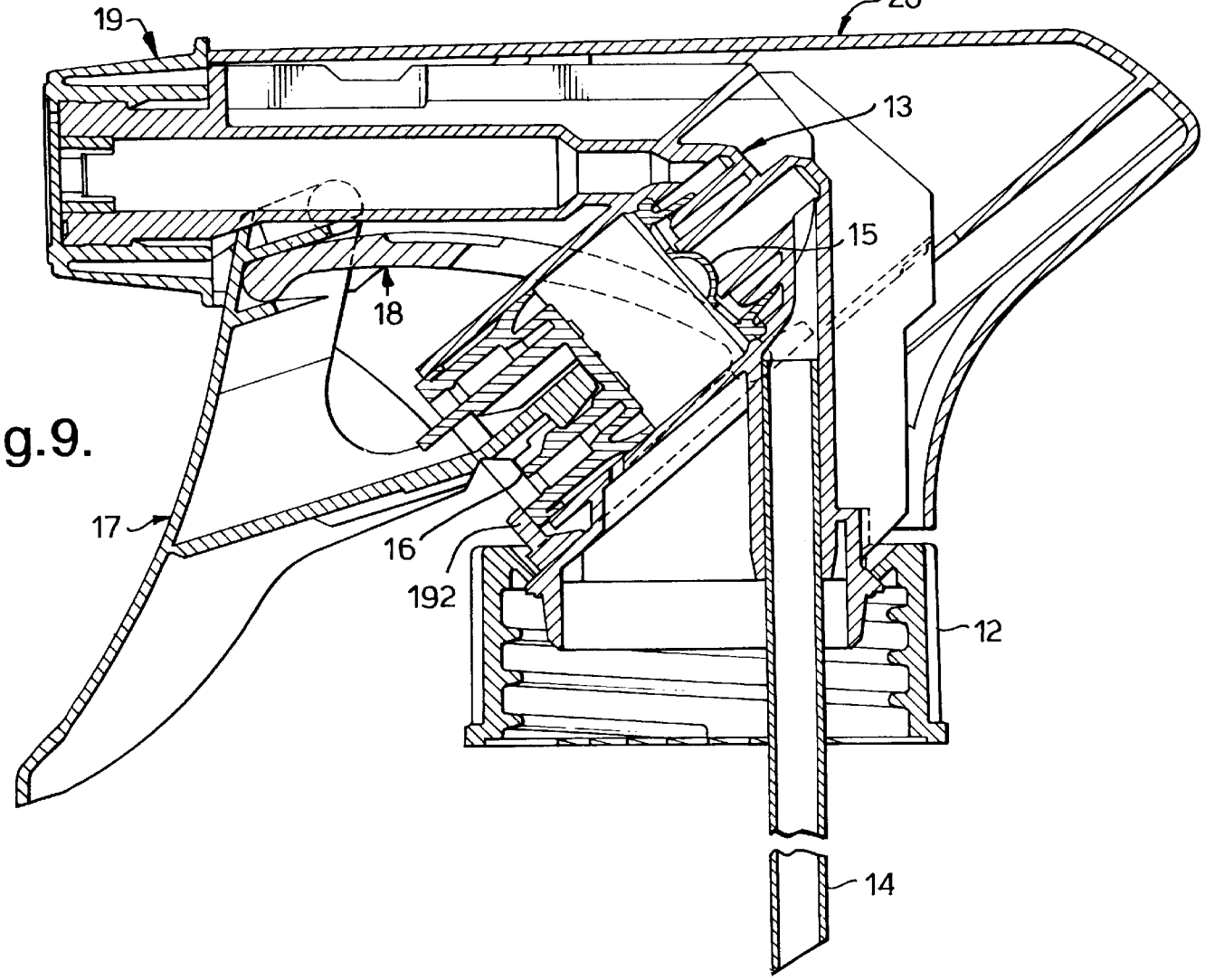
FIG. 9 similarly shows a third preferred trigger pump dispenser.

A third preferred dispenser is shown in general arrangement in FIG. 9. As with the first and second dispensers described above, this third dispenser has a plastics screw closure 12 by which it may be attached to the screw-threaded neck of a bottle (not shown). It comprises in addition a body 13, diptube 14, valve member 15, piston 16, trigger 17, spring 18, nozzle 19 and shroud 20 which are individually formed of suitable thermoplastic resin materials and are arranged and assembled together generally as described in relation to the first dispenser. The differences (other than dimensional) of the third dispenser from the first and second dispensers will become apparent from the following description given with reference to FIGS. 10 to 13.

Figure 10:
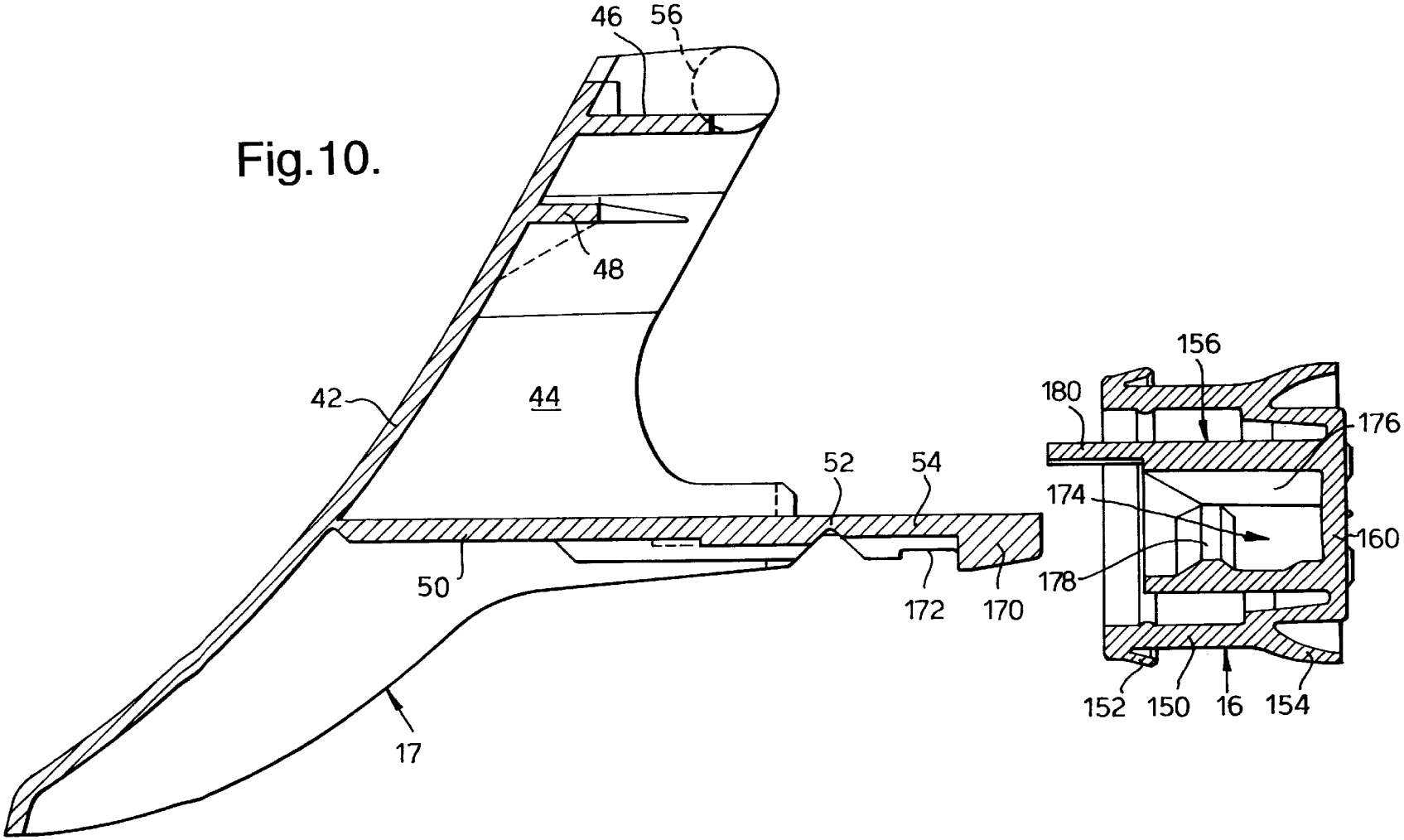
FIG. 10 is an exploded view illustrating the attachment of the trigger and piston of the third dispenser.
Figure 11:
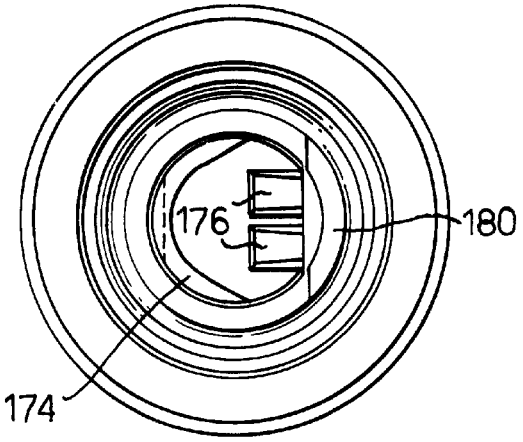
FIG. 11 shows the piston of the third dispenser as seen in end elevation looking on its open front face.

FIG. 10 is an exploded view of the trigger 17 and piston 16, showing a modified arrangement for attaching them to one another. As in the first two dispensers the trigger has a contoured front plate 42, and backwardly extending, spaced side plates 44. At the top of the trigger, the side plates carry aligned circular bosses 56 arranged for attaching the piston pivotally in the body 13.

Webs 46 and 48 bridge the distance between the side plates 44 and with the side plates provide a socket for loosely receiving and locating the top of the spring (not shown) for pivotal movement, while a further web 50 is attached by a living hinge 52 to an extension 54 which is likewise capable of snap-engaged retention in the piston 16. For that purpose the extension has an enlarged head 170, and a reduced cross-section neck 172 behind the head.

The piston 16 has an exterior tubular skirt 150 with resilient lips 152, 154 for sealing engagement with the pump cylinder. A central core 156 of the piston lies concentrically within the skirt and is attached to it by a crown 160 forming the front face of the piston.

The central core 156 is hollow and formed with a blind hole 176 along one side of which extends a pair of spaced projections 176 of generally rectangular cross-section. A partial bead 178 extends around the remaining peripheral length of the hole so as to engage the extension 54 within its neck 172 when the extension is push-fitted into the hole as far as it will go, guided by the projections 176. The projections and the bead then cooperate to hold the extension captive and so attach the piston to the trigger, but they leave a small degree of freedom for the extension to rock within the piston to allow for the fact that the living hinge 52 does not move strictly in a straight line parallel to the central axis of the pump chamber when the trigger is operated.

The central core 156 of the piston 16 is extended beyond its front face at a tab 180 which enables the piston to be oriented angularly in the pump cylinder 40 for assembly.

Figure 12A:
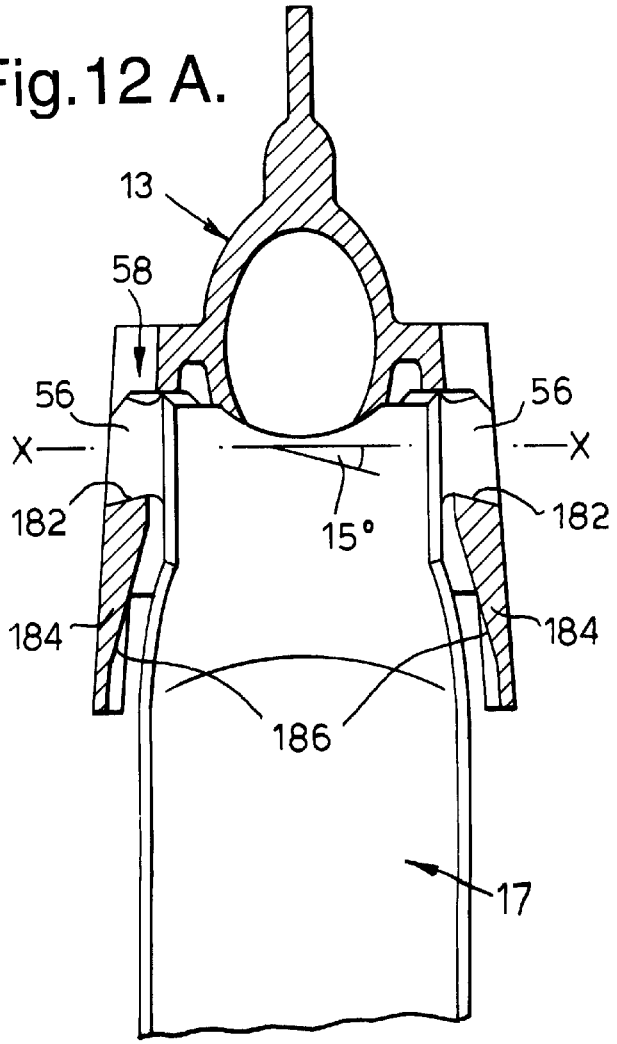
FIG. 12A is an enlarged view taken in section on the line XIIA—XIIA of FIG. 12, showing the pivotal attachment of the trigger to the body.
Figure 12:
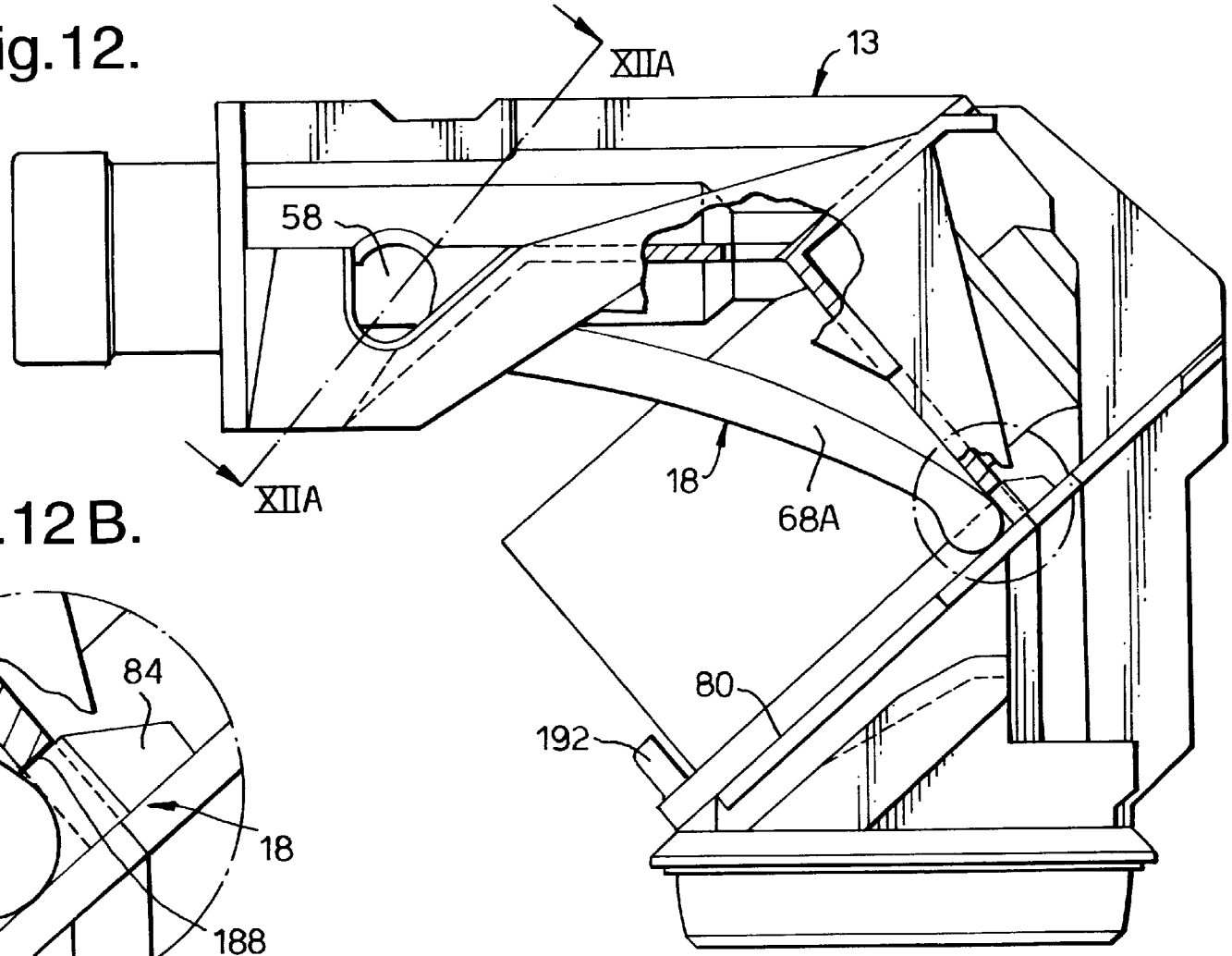
FIG. 12 shows the body and spring of the third dispenser when assembled together.

In addition to its modified engagement with the piston 16, the trigger 17 of the third pump dispenser is also modified to improve its retention in the body 13 at its top end. FIG. 12 shows the body when fitted with the spring 18, but with the other components of the dispenser omitted for clarity. FIG. 12A is a view taken on the inclined sectional line XIIA—XIIA of FIG. 12 with the trigger fitted, from which it will be seen that the bosses 56 of the trigger engage the recesses 58 of the body at bearing surfaces 182 which are downwardly and outwardly inclined at an angle of 15° to the pivotal axis XX of the trigger. The recesses 58 are formed by resilient side plates 60 having convergent inside faces 186 up which the bosses 56 ride for snap-engagement when the piston is being fitted in the body.

Figure 12B:
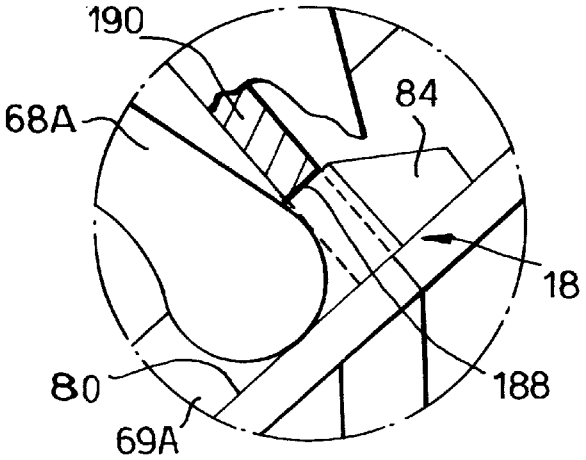
FIG. 12B is an enlarged view of the ringed part of FIG. 12, showing the snap-engagement of the rear end of the spring in the body.

FIG. 12B is an enlargement of the ringed area in FIG. 12 and showing further detail of the spring 18 and its engagement in the body 13. In FIG. 12B one of the tongues 84 of the spring is shown. It is snap-engaged through a respective opening 188 formed in a cross-member 190 of the body. The plane ledge 80 along which the spring is moved to create this snap-engagement when the spring is being fitted to the body is also shown.

A feature of the spring 18 of the third pump dispenser which is not present in the other two dispensers is a stop 192 which projects upwardly of the yoke 74 of the lower arm 69 (FIG. 3). As can be understood from FIG. 12 which shows it, the stop is positioned for defining the outer limiting position of the piston 16 in its pump chamber. It accordingly operates at the end of each product recharging stroke, when the piston moves under the biassing action of the spring 18.

Figures 13, 13A, 13B:
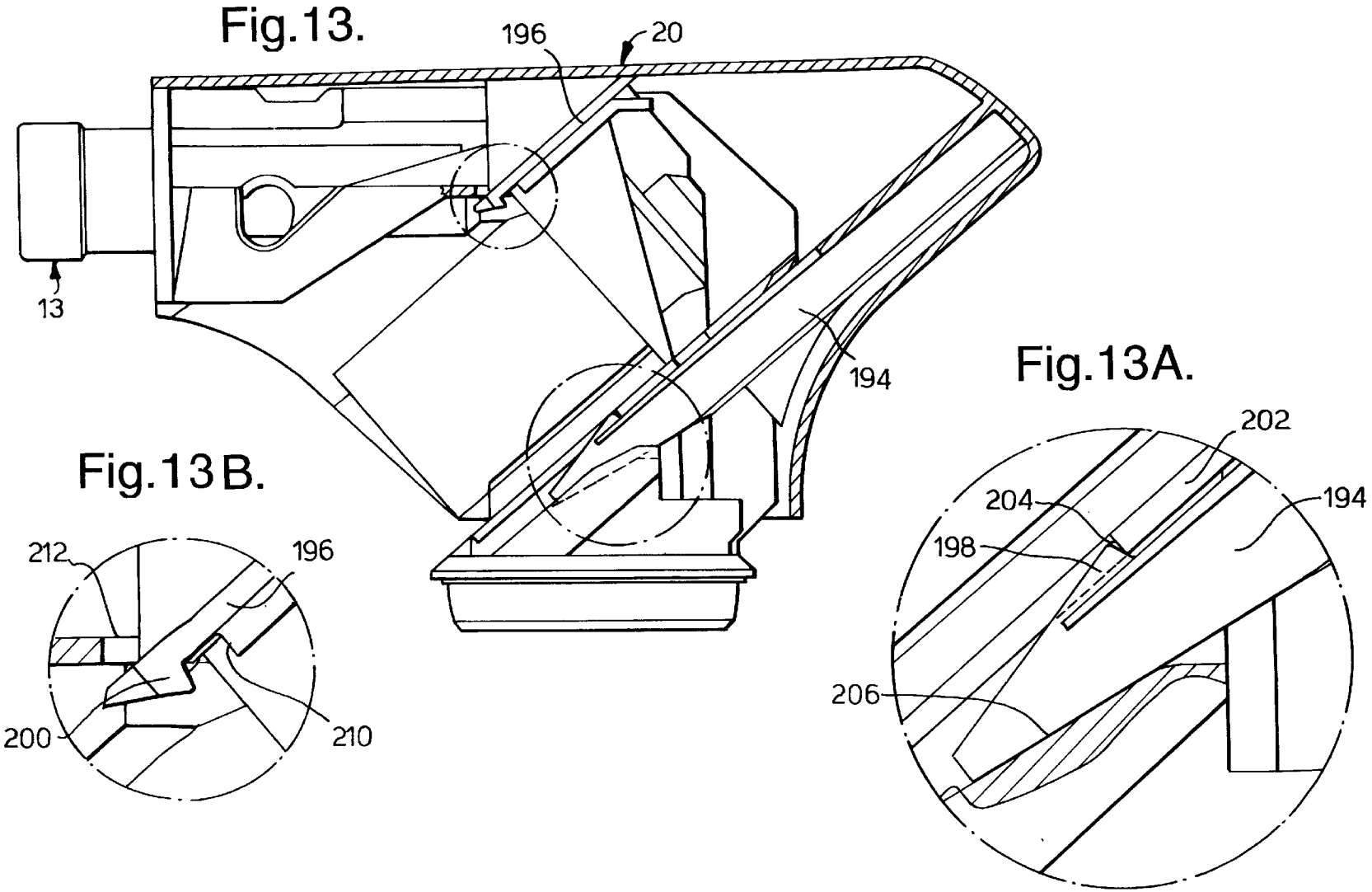
FIG. 13 shows the body and shroud of the third dispenser when assembled together.
FIGS. 13A and 13B are enlarged views of the ringed parts of FIG. 13, showing the snap-engagement of the shroud with the body.

FIG. 13 shows the shroud 20 when fitted to the body 13. The shroud has two pairs of transversely spaced spike formations 194, 196 extending in parallel relation and inclined with the angle at which the shroud is presented to the body for fitting. The spike formations are formed with hooks 198, 200. When the shroud is fitted to the body, the spike formations 194 ride along the underside of first flanges 202 formed on the body, until their hooks 198 engage behind end edges 204 of the flanges under the biasing action of cam faces 206. The spike formations 196 similarly ride along the top surfaces of second flanges 208 until their hooks 200 move behind end edges 210 of those flanges under the biasing action of projections 212 of the body.

In a preferred method of assembling the third dispenser the pump cylinder 40 is lubricated with a lubricating oil, and the valve member 15 and, subsequently, the piston 16 are push-fitted into it. The spring 18 is snap-engaged onto the body 13, after which the trigger 17 is assembled to the spring and to the body at its top end. Using the tab 180 the piston is turned in the pump cylinder as necessary for reception of the trigger extension 54; the extension can then be snap-engaged into the piston. The body is lubricated with a lubricating oil in preparation for the nozzle 19, and the nozzle is fitted. The closure 12, shroud 20, and diptube 14 are fitted subsequently, and preferably in that order.

We claim:

1. A trigger pump dispenser having a spring (18) for a trigger (17), a dispenser body (13) and a pump chamber (38), characterized in that the spring (18) for the trigger (17) is generally L-shaped in cross-section, having upper and lower arms (68, 59) joined at an elbow (70) from which they each extend generally forwardly of the pump dispenser, the lower arm being attached to the dispenser body (13) below the pump chamber (38), and the upper arm being flexible and resilient, cantilevered from the lower arm at the elbow, and movably engaged at its free end with the trigger.

2. A dispenser according to claim 1, characterized in that the upper arm (68) of the spring has two parts (68A) arranged to straddle the dispenser body (13) below the pump chamber.

3. A dispenser according to claim 2, characterized in that the free end of the upper arm (68) of the spring (18) is pivotally attached to the trigger (17) at a predetermined location on the trigger.

4. A dispenser according to claim 2, characterized in that the two parts (68A) of the upper arm (68) of the spring (18) are joined at their free ends by a first yoke (72) and the two parts (69A) of the lower arm (69) are joined at their free ends by a second yoke (74).

5. A dispenser according to claim 4, characterized in that the first yoke (72) of the spring (18) is located in a socket of the trigger (17) for pivotal movement in relation to the trigger at a predetermined location thereof.

6. A dispenser according to claim 5, wherein the first yoke (72) of the spring (18) is formed with laterally aligned bosses (76) for said pivotal movement.

7. A dispenser according to claim 6, characterized in that the second yoke (74) of the spring (18) is located adjacent the front end of the pump chamber (38) of the dispenser and carries an upstanding limit stop (192) for providing a limit to movement of the piston (16) in its pump chamber recharging direction.

8. A dispenser according to claim 7, characterized in that the spring (18) has formations (84) located adjacent its elbow (70) and snap-engaged in the body (13) for holding the parts (69A) of the lower arm (69)immovable on the body.

9. A dispenser according to claim 8, characterized in that the spring (18) is molded from polyacetal.

10. A trigger pump dispenser, which has a pump chamber and a unitary valve member (15) associated therewith and having inner and outer portions (116, 112) arranged one within the other with apertures (120) formed through the valve member between them, the inner portion (116) cooperating with a seat (136) and providing a one-way valve for the inlet flow path to the pump chamber and the outer portion (112) cooperating with the valve seat (136) and providing a one-way valve for the outlet flow path from the pump chamber, the apertures (120) form a part of each of the inlet and outlet flow paths, characterized in that the valve member (15) further includes a formation (114) by which it is attached immovably to the dispenser body (13), the formation (114) being disposed operatively between the outer portion (112) on its outside and the inner portion (116) and the apertures (120) on its inside, and the outer and inner portions (112, 116) being individually movable relative to the formation (114).

11. A dispenser according to claim 10, characterized in that the outlet portion (112) of the valve member (15) is tubular, and arranged for its interior surface to engage a generally cylindrical valve seat (136).

12. A dispenser according to claim 11, characterized in that the valve seat (136) is provided by the exterior surface of a tubular wall structure (134) the free end of which provides a valve seat for engagement by the inner portion (116) of the valve member (15).

13. A dispenser according claim 12, characterized in that the valve member is generally cup-shaped, having a base (110) formed with a dome (116), a tubular skirt (112) extending peripherally from the base in the same direction as the dome, the apertures (120) formed in the base around the dome, and the formation (114) disposed at the junction of the base with the skirt and attaching the valve member to the dispenser body (13), the dome providing the one-way valve for the inlet flow path and the skirt providing the one-way valve for the outlet flow path, and the apertures forming a part of both flow paths.

14. A dispenser according to claim 13, characterized in that for providing the one-way valves for the inlet and outlet flow paths the dome (116) and the skirt (112) respectively engage inner and outer surfaces of the tubular wall structure (134) of the dispenser body.

15. A dispenser according to claim 14, characterized in that the valve member (15) is push-fitted along the pump chamber (38) to a location at the back of the pump chamber.

16. An all plastic manually operable trigger pump dispenser for use and incorporation on a container for liquid to be dispensed, comprising in combination:

a component retaining body comprising a cylinder having an axis;

a piston in the cylinder defining therewith a variable volume pump chamber adapted to assume a retracted position at which the chamber assumes a first position of large volume and an inserted position at which the chamber assumes a second position of lesser volume;

a trigger carried by said body and coupled with the piston and adapted to be digitally moved from a starting position at which the piston is in the retracted position and a depressed position at which the piston is in the inserted position and moved back to the starting position;

a spring means coupled with surfaces of the body and trigger for biasing the trigger towards its retracted position;

the spring means being generally L-shaped in side elevation, and having one arm anchored to the body and another arm flexible, resilient and cantilevered from the first arm and having a free end pivotally coupled with trigger;

an inlet valve adapted to close the inlet port when liquid to be dispensed is in the pump chamber and when the piston is moved from the retracted position to the inserted position as the pump chamber decreases in volume, the inlet valve being adapted to open the inlet port when the liquid to be dispensed is drawn into the pump chamber through the inlet port as the pump chamber volume increases when the piston is moved from the inserted position to the retracted position;

an outlet valve adapted to open the outlet port when the pump chamber decreases in volume as the liquid therein is dispensed through the outlet port and adapted to close when the pump chamber increases in volume;

passage means defined by surfaces of the body for cooperating in directing the liquid to be dispensed out from the outlet port and eventually into a selected discharge pattern;

a nozzle on the body for directing the liquid to be dispensed from the passage means into the selected discharge pattern;

means for coupling the body to the container having a headspace; and vent means for communicating the container headspace with the ambient.

17. A dispenser in accordance with claim 16, wherein the flexible arm of the spring means is located above the one arm, the one arm being anchored to the body below the cylinder.

18. A dispenser in accordance with claim 17, wherein the flexible arm has two bifurcated arm parts constructed and arranged to straddle the cylinder, and the one arm has two bifurcated arm parts constructed and arranged to straddle the body below the cylinder.

19. A dispenser in accordance with claim 18, wherein the body has an inclined plane ledge approximately parallel to the cylinder axis and the one arm rests on and is supported by the ledge.

20. An all plastic manually operable trigger pump dispenser for use and incorporation on a container for liquid to be dispensed, comprising in combination:

a component retaining body comprising a cylinder;

a piston in the cylinder defining therewith a variable volume pump chamber adapted to assume a retracted position at which the chamber assumes a first position of large volume and an inserted position at which the chamber assumes a second position of lesser volume, the piston having a distal end and a proximal end;

a trigger carried by said body and coupled with the piston and adapted to be digitally moved from a starting position at which the piston is in the retracted position and a depressed position at which the piston is in the inserted position and moved back to the starting position, the trigger having a pivotal extension attached thereto by a living hinge and being coupled with the piston;

a spring means coupled with surfaces of the body and trigger for biasing the trigger towards its retracted position;

an inlet port and outlet port defined by surfaces of the body and adapted to be in communication with the pump chamber;

a unitary valve body having an inlet valve, outlet valve, and a formation by which it is attached immovably to the component retaining body, the formation being disposed operatively between an outer portion on its outside cooperating to define the outlet valve and an inner portion on its inside cooperating to define the inlet valve, the outer and inner portions being individually movable relative to the formation;

the inlet valve adapted to close the inlet port when liquid to be dispensed is in the pump chamber and when the piston is moved from the retracted position to the inserted position as the pump chamber decreases in volume, the inlet valve being adapted to open the inlet port when the liquid to be dispensed is drawn into the pump chamber through the inlet port as the pump chamber volume increases when the piston is moved from the inserted position to the retracted position;

the outlet valve adapted to open the outlet port when the pump chamber decreases in volume as the liquid therein is dispensed through the outlet port and adapted to close when the pump chamber increases in volume;

passage means defined by surfaces of the body for cooperating in directing the liquid to be dispensed out from the outlet port and eventually into a selected discharge pattern;

a nozzle on the body for directing the liquid to be dispensed from the passage means into the selected discharge pattern;

means for coupling the body to the container having a headspace; and vent means for communicating the container headspace with the ambient.

21. An all plastic manually operable trigger pump dispenser for use and incorporation on a container for liquid to be dispensed, comprising in combination:

a component retaining body comprising a cylinder;

a piston in the cylinder defining therewith a variable volume pump chamber adapted to assume a retracted position at which the chamber assumes a first position of large volume and an inserted position at which the chamber assumes a second position of lesser volume, the piston having a distal end and a proximal end;

a trigger carried by said body and coupled with the piston and adapted to be digitally moved from a starting position at which the piston is in the retracted position and a depressed position at which the piston is in the inserted position and moved back to the starting position, the trigger having a pivotal extension attached thereto by a living hinge and being coupled with the piston;

a spring means coupled with surfaces of the body and trigger for biasing the trigger towards its retracted position;

an inlet port and outlet port defined by surfaces of the body and adapted to be in communication with the pump chamber;

an inlet valve adapted to close the inlet port when liquid to be dispensed is in the pump chamber and when the piston is moved from the retracted position to the inserted position as the pump chamber decreases in volume, the inlet valve being adapted to open the inlet port when the liquid to be dispensed is drawn into the pump chamber through the inlet port as the pump chamber volume increases when the piston is moved from the inserted position to the retracted position;

an outlet valve adapted to open the outlet port when the pump chamber decreases in volume as the liquid therein is dispensed through the outlet port and adapted to close when the pump chamber increases in volume;

passage means defined by surfaces of the body for cooperating in directing the liquid to be dispensed out from the outlet port and eventually into a selected discharge pattern;

a nozzle on the body for directing the liquid to be dispensed from the passage means into the selected discharge pattern;

means for coupling the body to the container having a headspace;

vent means for communicating the container headspace with the ambient; and the extension and piston having interengaged projecting surfaces providing a snap-lock engagement.

22. A dispenser in accordance with claim 21, wherein the projecting surface of the piston is provided by a tongue hinged at the proximal end and extending toward the distal end and the projecting surface of the extension is provided by a laterally extending rib.

23. An all plastic manually operable trigger pump dispenser for use and incorporation on a container for liquid to be dispensed, comprising in combination:

a component retaining body comprising a cylinder;

a piston in the cylinder defining therewith a variable volume pump chamber adapted to assume a retracted position at which the chamber assumes a first position of large volume and an inserted position at which the chamber assumes a second position of lesser volume, the piston having a distal end and a proximal end;

a trigger carried by said body and coupled with the piston and adapted to be digitally moved from a starting position at which the piston is in the retracted position and a depressed position at which the piston is in the inserted position and moved back to the starting position, the trigger having a pivotal extension attached thereto by a living hinge and being coupled with the piston;

a spring means coupled with surfaces of the body and trigger for biasing the trigger towards its retracted position;

an inlet port and outlet port defined by surfaces of the body and adapted to be in communication with the pump chamber;

an inlet valve adapted to close the inlet port when liquid to be dispensed is in the pump chamber and when the piston is moved from the retracted position to the inserted position as the pump chamber decreases in volume, the inlet valve being adapted to open the inlet port when the liquid to be dispensed is drawn into the pump chamber through the inlet port as the pump chamber volume increases when the piston is moved from the inserted position to the retracted position;

an outlet valve adapted to open the outlet port when the pump chamber decreases in volume as the liquid therein is dispensed through the outlet port and adapted to close when the pump chamber increases in volume;

passage means defined by surfaces of the body for cooperating in directing the liquid to be dispensed out from the outlet port and eventually into a selected discharge pattern;

a nozzle on the body for directing the liquid to be dispensed from the passage means into the selected discharge pattern;

means for coupling the body to the container having a headspace;

vent means for communicating the container headspace with the ambient; and the piston including a central axis and a closed distal end and an open proximal end, and the extension extending through the open proximal end for a substantial distance up to the distal closed end along the central axis.

24. A dispenser in accordance with claim 23, wherein the extension and piston have interengaged projecting surfaces providing a snap-lock engagement; and the projecting surface of the piston is provided by a tongue hinged at the proximal end and extending toward the distal end and the projecting surface of the extension is provided by a laterally extending rib.

25. An all plastic manually operable trigger pump dispenser for use and incorporation on a container for liquid to be dispensed comprising in combination:

a component retaining body comprising a cylinder;

a piston in the cylinder defining therewith a variable volume pump chamber adapted to assume a retracted position at which the chamber assumes a first position of large volume and an inserted position at which the chamber assumes a second position of lesser volume, the piston having a distal end and a proximal end;

a trigger carried by said body and coupled with the piston and adapted to be digitally moved from a starting position at which the piston is in the retracted position and a depressed position at which the piston is in the inserted position and moved back to the starting position, the trigger having a pivotal extension attached to thereto by a living hinge and being coupled with the piston;

a spring means coupled with surfaces of the body and trigger for biasing the trigger towards its retracted position;

the spring means being generally L-shaped in side elevation, and having one arm anchored to the body and another arm flexible, resilient and cantilevered from the one arm and having a free end pivotally coupled with trigger;

an inlet port and outlet port defined by surfaces of the body and adapted to be in communication with the pump chamber;

an inlet valve adapted to close the inlet port when liquid to be dispensed is in the pump chamber and when the piston is moved from the retracted position to the inserted position as the pump chamber decreases in volume, the inlet valve being adapted to open the inlet port when the liquid to be dispensed is drawn into the pump chamber through the inlet port as the pump chamber volume increases when the piston is moved from the inserted position to the retracted position;

an outlet valve adapted to open the outlet port when the pump chamber decreases in volume as the liquid therein is dispensed through the outlet port and adapted to close when the pump chamber increases in volume;

the inlet valve and outlet valve being a unitary valve member having means for connecting the valve member to the body;

passage means defined by surfaces of the body for cooperating in directing the liquid to be dispensed out from the outlet port and eventually into a selected discharge pattern;

a nozzle on the body for directing the liquid to be dispensed from the passage means into the selected discharge pattern;

means for coupling the body to the container having a headspace; and vent means for communicating the container headspace with the ambient.

26. A dispenser in accordance with claim 25, wherein air network means are provided for permitting the passage of air from the ambient into the container to replenish the volume of the liquid to be dispensed which is drawn from the container interior into the pump chamber through the inlet port.

27. A dispenser in accordance with claim 25, wherein the container has a neck and the means for coupling the body to the container being a cap connected with the container neck.

28. A dispenser in accordance with claim 25, wherein a shroud embraces the sprayer and is coupled with the body.

29. A dispenser in accordance with claim 25, wherein the body has a lower end and a dip tube coupled with the lower end of the body.

* * * * *